US006974067B2

(12) United States Patent
Chen

(10) Patent No.: US 6,974,067 B2
(45) Date of Patent: Dec. 13, 2005

(54) MAGAZINE FOR USE IN NAIL STAPLER

(76) Inventor: Mu-Yu Chen, No. 78, Ta Tun 17th Street, Hsi Tun District, Taichung (TW)

( * ) Notice: Subject to any disclaimer, the term of this patent is extended or adjusted under 35 U.S.C. 154(b) by 11 days.

(21) Appl. No.: 10/434,791

(22) Filed: May 8, 2003

(65) Prior Publication Data

US 2003/0201299 A1 Oct. 30, 2003

Related U.S. Application Data

(63) Continuation-in-part of application No. 10/133,277, filed on Apr. 29, 2002, now Pat. No. 6,715,657.

(51) Int. Cl.[7] ..... B25C 7/00

(52) U.S. Cl. ..... 227/120; 227/109; 227/119; 227/135; 227/139

(58) Field of Search ..... 227/109, 119, 227/120, 135, 139

(56) References Cited

U.S. PATENT DOCUMENTS 4,749,115 A * 6/1988 Fehrs ..... 227/109
4,815,647 A * 3/1989 Chou ..... 227/109
5,368,213 A * 11/1994 Massari, Jr. ..... 227/123
5,433,367 A * 7/1995 Liu ..... 227/120
5,632,431 A * 5/1997 Lin ..... 227/109
5,695,108 A * 12/1997 Lee ..... 227/109
5,794,832 A * 8/1998 Chen ..... 227/109
5,873,509 A * 2/1999 Liao ..... 227/109
6,092,711 A * 7/2000 Tinarelli ..... 227/109

* cited by examiner

*Primary Examiner*—Louis Huynh
*Assistant Examiner*—Nathaniel Cnhukwurah
(74) *Attorney, Agent, or Firm*—Charles E. Baxley

(57) ABSTRACT

A nail stapler magazine includes a storing device, a feeding device, a gate and a distinguisher. The storing device is for storing nails and first and second types of staples each including first and second legs. The feeding device is for feeding the nails and the first and second types of staples from the storing device. The nails and the first and second types of staples are fed through the gate. The distinguisher is for distinguishing the nails and the first and second types of staples from one another and ensuring that only one of the nails and the first and second types of staples is fed at a time.

12 Claims, 4 Drawing Sheets

MAGAZINE FOR USE IN NAIL STAPLER

CROSS REFERENCE

The present application is a continuation-in-part application of U.S. patent application Ser. No. 10/133,277 filed Apr. 29, 2002 now U.S. Pat. No. 6,715,657 of which the entire disclosure is incorporated here.

FIELD OF INVENTION

The present invention is related to a nail stapler and, more particularly, to a magazine for use in a nail stapler.

BACKGROUND OF INVENTION

U.S. patent application Ser. No. 10/133,277 now U.S. Pat. No. 6,715,657 filed by the applicant of the present application discloses a magazine for use in a nail stapler capable of storing a type of nails and a type of staples. However since many types of nails are used, the magazine capable of storing two types of nails might be insufficient.

The present invention is therefore intended to obviate or at least alleviate the drawback encountered in the prior art.

SUMMARY OF INVENTION

It is the primary objective of the present invention to provide a nail stapler with a magazine capable of containing a type of nails and two types of staples and providing nails or staples without the need for manual adjustment thereof.

According to the present invention, a nail stapler magazine includes a storing device, a feeding device, a gate and a distinguisher. The storing device is for storing nails and first and second types of staples each including first and second legs. The feeding device is for feeding the nails and the first and second types of staples from the storing device. The nails and the first and second types of staples are fed through the gate. The distinguisher is for distinguishing the nails and the first and second types of staples from one another and ensuring that only one of the nails and the first and second types of staples is fed at a time.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
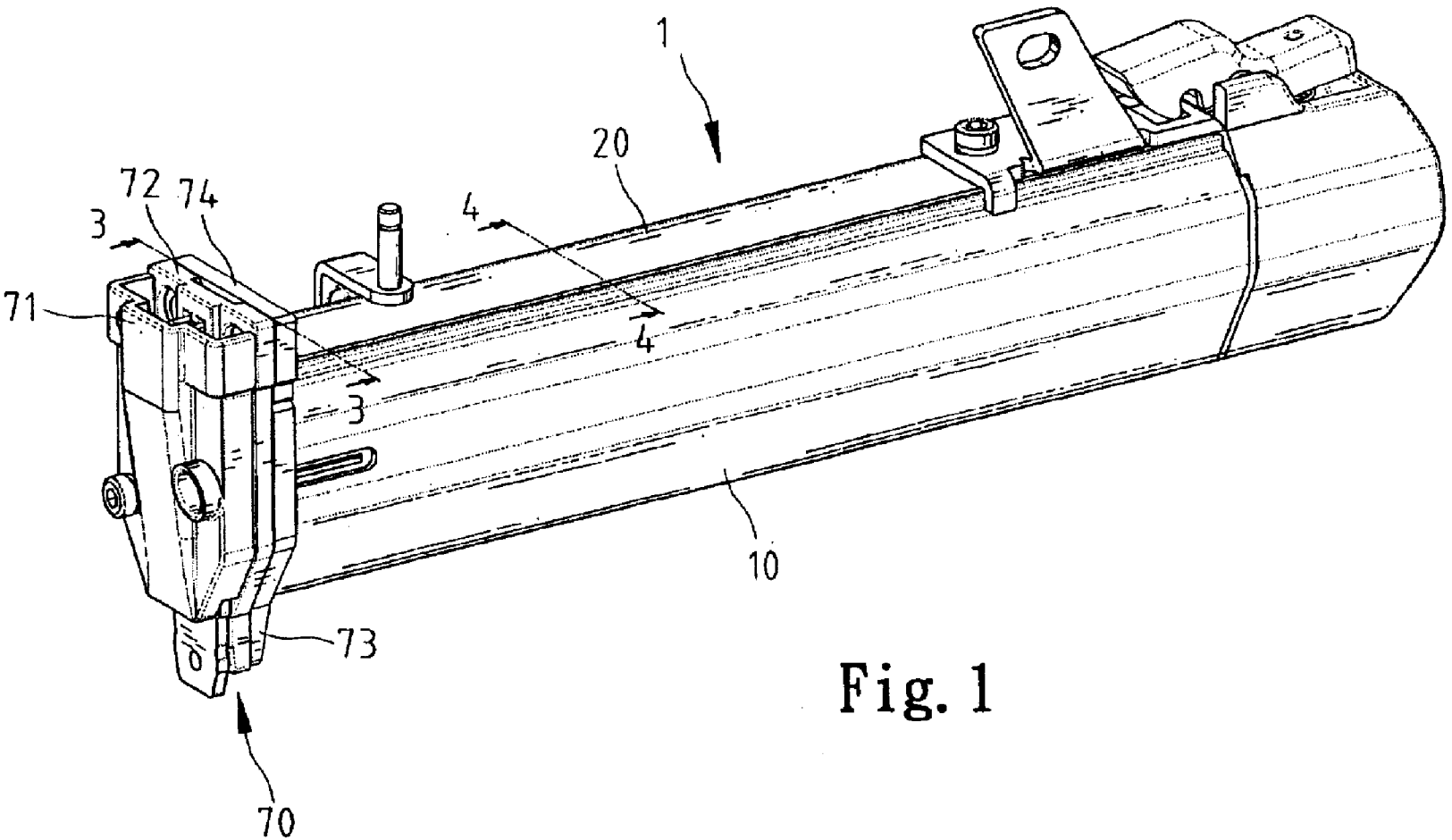
FIG. 1 is a perspective view of a nail stapler with a magazine according to the preferred embodiment of the present invention.
Figure 5:
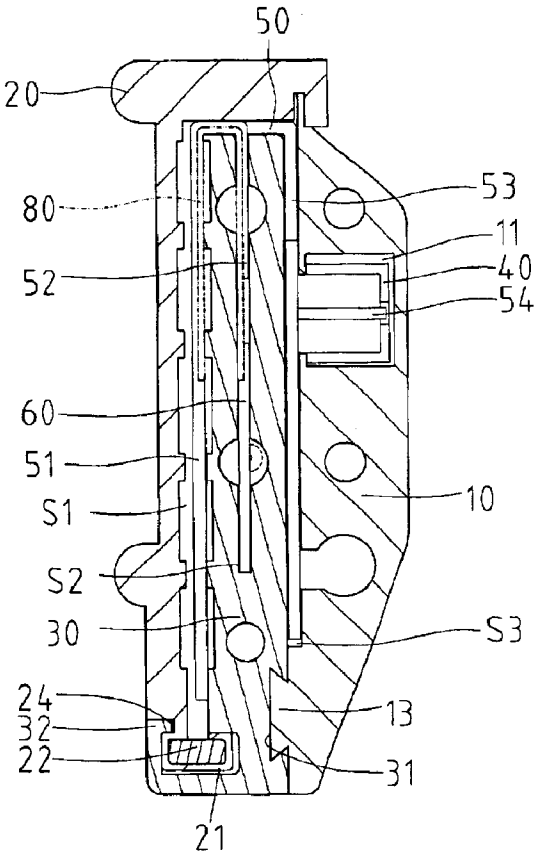
FIG. 5 is similar to FIG. 4 but showing the magazine storing staples.
Figure 6:
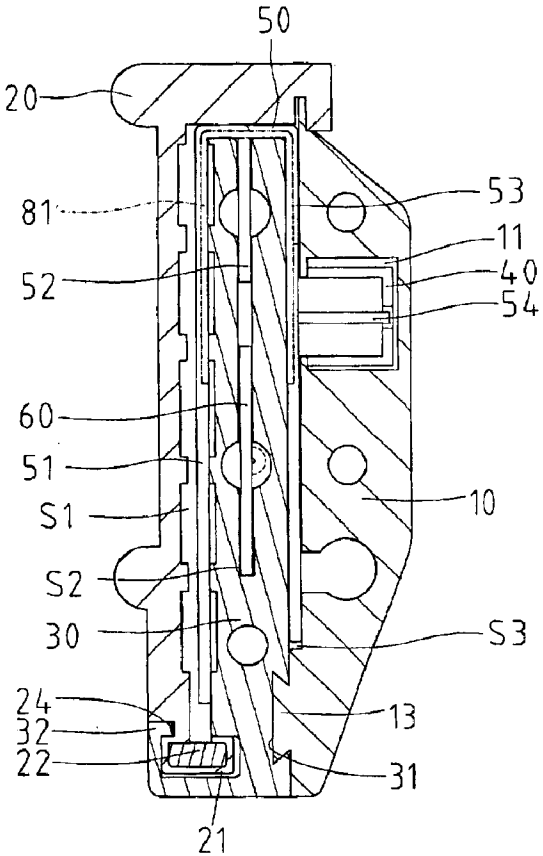
FIG. 6 is similar to FIG. 5 but showing the magazine storing another type of staples.

Referring to FIG. 1, the present invention provides a nail stapler (not shown) with a magazine 1 capable of storing and feeding nails 82 (see FIG. 4), a first type of staples 80 (see FIG. 5) and a second type of staples 81 (see FIG. 6). The staples 80 and 81 each include first and second legs.

Figure 2:
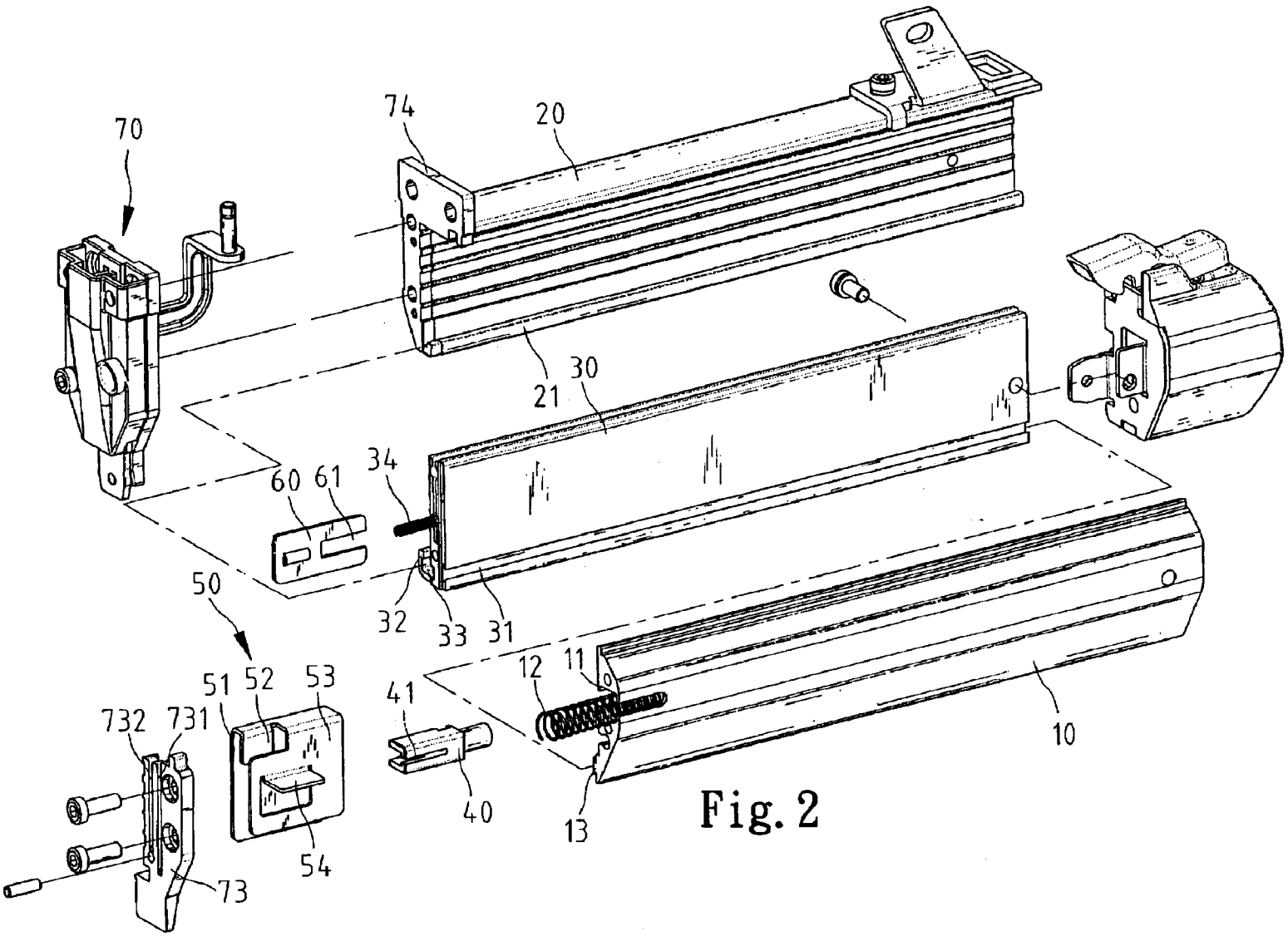
FIG. 2 is an exploded view of the magazine shown in FIG. 1.
Figure 3:
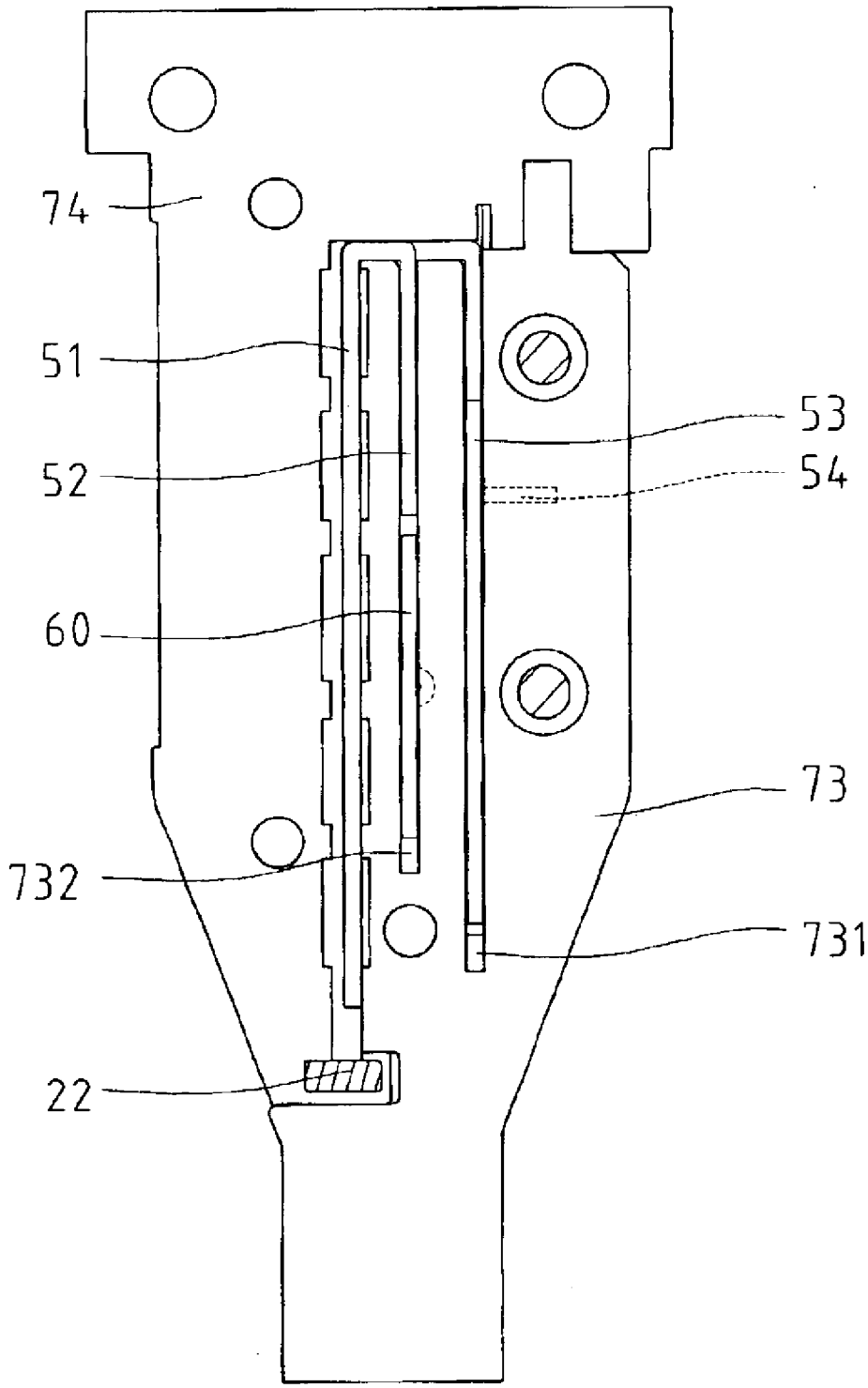
FIG. 3 is a cross-sectional view of the magazine taken along a line 3—3 in FIG. 1.

Referring to FIGS. 2 and 3, the magazine 1 includes a storing device for storing the staples 80 and 81 and the nails 82, a feeding device for feeding the staples 80 and 81 and the nails 82 from the storing device, a gate through which the staples 80 and 81 and the nails 82 can be fed and a distinguisher 70 for distinguishing the staples 80 and 81 and the nails 82 from one another and ensuring that that only one staple 80 or 81 or nail 82 is fed at a time.

The storing device includes a first member 20, a second member 30 and a third member 10. The second member 30 is located between the first member 20 and the third member 10. A first space S1 is defined between the first member 20 and the second member 30, and a second space S2 in the second member 30, and a third space S3 between the second member 30 and the third member 10.

The first member 20 includes internal and external walls. In the internal wall of the first member 20 are defined grooves for receiving and guiding the heads of the nails 82. A rib 21 is formed on the internal wall of the first member 20. A groove 24 is defined in the external wall of the first member 20. The first member 20 of the storing device of the present application is otherwise substantially identical to the shell 20 of the storing device of U.S. patent application Ser. No. 10/133,277 now U.S. Pat. No. 6,715,657 and will not be described in detail.

The second member 30 includes a first wall and a second wall. In the first wall of the second member 30 are defined grooves for receiving and guiding the heads of the nails 82. A groove 33 is defined in the first wall of the second member 30. The second member 30 includes a clip 32 extending horizontally from the first wall, then upwards and finally horizontally towards the first wall. The clip 32 is located below the groove 11. A dovetail groove 31 is defined in the second wall of the second member 30.

To connect the first member 20 with the second member 30, the rib 21 is inserted in the groove 33, and the groove 24 receives an edge of the clip 32.

The third member 10 includes an internal wall and an external wall. A groove 11 is defined in the internal wall of the third member 10 of the storing device. A dovetail 13 is formed on the internal wall of the third member 10.

To connect the second member 30 with the third member 10, the dovetail slot 31 receives the dovetail 13.

The feeding device includes a spring 12 received in the groove 11, a feeder 50 and a joint 40 for connecting the spring 12 with the feeder 50.

The joint 40 defines a slit 41. The joint 40 is substantially identical to the joints 33 of U.S. patent application Ser. No. 10/133,277 now U.S. Pat. No. 6,715,657 and will not be described in detail.

The feeder 50 includes a first member 51, a second member 52, a third member 53 and a fourth member 54 extending from the third member 53. The first member 51 is put in the first space S1, and the second member 52 in the second space S2, and the third member 53 in the third space S3.

In the preferred embodiment, the feeder 50 is made from a strip of metal. Firstly, a reversed L-shaped slit is cut in the strip. Secondly, a portion of the strip surrounded in the reversed L-shaped slit is bent, thus forming the second member 52. Finally, the strip is bent so as to form an inverted U-shaped element, thus forming the first member 51 and the third member 53. Thus, the second member 52 is much shorter than the first member 51 and the third member 53. Therefore, it is preferred that an auxiliary feeder 60 is put in the second space S2. A spring 34 is also put in the second space S2. The auxiliary feeder 60 defines a recess 61 for receiving an end of the spring 34.

The gate includes a first member 74 and a second member 73. The first member 74 of the gate of the present application is substantially identical to the plate 40 of U.S. patent application Ser. No. 10/133,277, and will not be described in detail. The first member 74 of the gate is attached to the first member 20 of the storing device. The second member 73 defines a slit 732 corresponding to the second space S2 and a slit 731 corresponding to the third space S3. The second member 73 of the gate is attached to the third member 10 of the storing device. The second member 73 of the gate of the present application is otherwise substantially identical to the plate 50 of U.S. patent application Ser. No. 10/133,277 now U.S. Pat. No. 6,715,657 and will not be described in detail.

The distinguisher 70 of the present application is substantially identical to the distinguisher 60 of U.S. patent application Ser. No. 10/133,277 now U.S. Pat. No. 6,715,657 and will not be described in detail.

Figure 4:
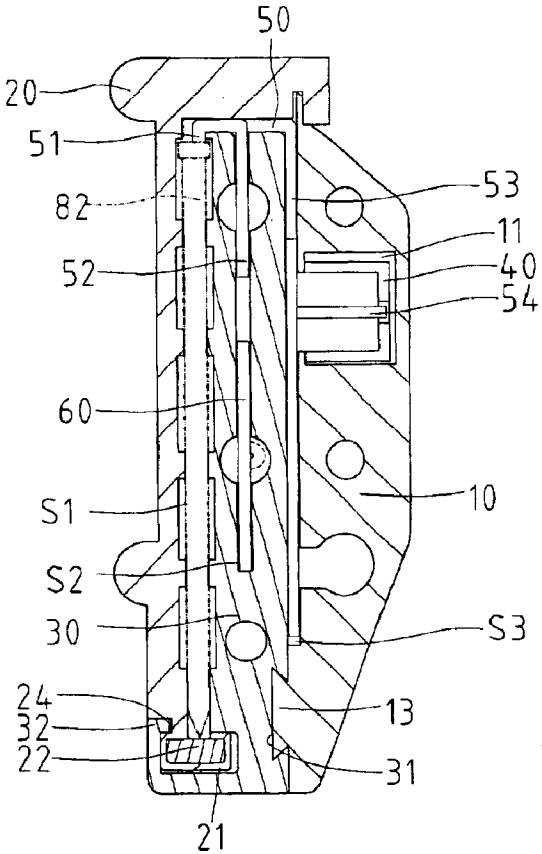
FIG. 4 is a cross-sectional view of the magazine taken along a line 4—4 in FIG. 1.

Referring to FIG. 4, the nails 82 are put in the first space S1, and pushed by means of the first member 51 of the feeder 50.

Referring to FIG. 5, the staples 80 are stored in the magazine 1. In the first space S1, the first legs of the staples 80 are pushed by means of the first member 51 of the feeder 50. In the second space S2, the second legs of the staples 80 are pushed by means of the second member 52 of the feeder 50. If the second legs of the staples 80 are long, they are not only pushed by means of the second member 52 of the feeder 50 but also by means of the auxiliary feeder 60.

Referring to FIG. 6, the staples 81 are stored in the magazine 1. In the first space S1, the first legs of the staples 81 are pushed by means of the first member 51 of the feeder 50. In the third space S3, the second legs of the staples 81 are pushed by means of the third member 53 of the feeder 50.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A nail stapler magazine including:

a storing device for storing nails and first and second types of staples each including first and second legs;

a feeding device for feeding the nails and the first and second types of staples from the storing device;

a gate through which the nails and the first and second types of staples are fed; and a distinguisher for distinguishing the nails and the first and second types of staples from one another and ensuring that only one of the nails and the first and second types of staples is fed at a time wherein the storing device includes:

a first member;

a second member connected with the first member so as to define a first space between them for storing the nails and the first legs of the first type of staples, the second member defining a second space for storing the second legs of the first type of staples; and a third member connected with the second member so as to define a third space between the second and third members for storing the second legs of the second type of staples.

2. The nail stapler magazine according to claim 1 wherein the first and second members both define a plurality of grooves for receiving and guiding the heads of the nails.

3. The nail stapler magazine according to claim 1 wherein the first member includes a rib formed thereon, wherein the second member defines a groove for receiving the rib.

4. The nail stapler magazine according to claim 1 wherein the second member includes a clip formed thereon for clamping the first member.

5. The nail stapler magazine according to claim 4 wherein the clip includes an edge, and the first member defines a groove for receiving the edge of the clip.

6. The nail stapler magazine according to claim 1 wherein the feeding device includes a feeder for feeding the nails and the staples wherein the feeder includes a first member put in the first space, a second member put in the second space and a third member put in the third space.

7. The nail stapler magazine according to claim 6 wherein the feeder is made from a strip of metal via a process including:

a step of cutting a reversed L-shaped slit in the strip;

a step of bending a portion of the stip surrounded in the reversed L-shaped slit, thus forming the second member;

a step of bending the stip so as to form an inverted U-shaped element, thus forming the first member and the third member so that the second member is shorter than the first member and the third member.

8. A nail stapler magazine including:

a storing device for storing nails and first and second types of staples each including first and second legs;

a feeding device for feeding the nails and the first and second types of staples from the storing device;

a gate through which the nails and the first and second types of staples are fed; and a distinguisher for distinguishing the nails and the first and second types of staples from one another ensuring that only one of the nails and the first and second types of staples is fed at a time wherein the feeding device includes a feeder for feeding the nails and the staples and wherein the feeder includes a first member put in the first space, a second member put in the second space and a third member put in the third space.

9. The nail stapler magazine according to claim 6 wherein the feeder is made from a strip of metal via a process including:

a step of cutting a reversed L-shaped slit in the strip;

a step of bending a portion of the strip surrounded in the reversed L- shaped slit, thus forming a second member;

a step of bending the strip so as to form an invertedU-shaped element, thus forming the first member and the third member so that the second member is shorter than the first member and the third member.

10. The nail stapler magazine according to claim 7 wherein the feeding device includes an auxiliary feeder put in the second space and a spring put in the second space for biasing the auxillary feed.

11. The nail stapler magazine according to claim 8 wherein the auxiliary feeder defines a recess for receiving and end of the spring.

12. A nail stapler magazing including:

a storing device for storing nails and first and second types of staples each including first and second legs;

a feeding device for feeding the nails and the first and second types of staples from the storing device;

a gate through which the nails and the first and second types of staples are fed; and a distinguisher for distinguishing the nails and the first and second types of staples from one another end ensuring that only one of the nails and the first and second types of staples is fed at a time wherein the feeding device includes a feeder for feeding the nails and the staples wherein the feeding device includes a spring for biasing the feeder and wherein the third member defines a groove for receiving the spring.

* * * * *